US006767080B2

(12) United States Patent
Kanematsu

(10) Patent No.: US 6,767,080 B2
(45) Date of Patent: Jul. 27, 2004

(54) INK-JET RECORDING APPARATUS, AND INK-TEMPERATURE CONTROL METHOD IN THE SAME

(75) Inventor: Daigoro Kanematsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/238,678

(22) Filed: Sep. 11, 2002

(65) Prior Publication Data

US 2003/0052935 A1 Mar. 20, 2003

(30) Foreign Application Priority Data

Sep. 17, 2001 (JP) ..... 2001-282106

(51) Int. Cl.[7] ..... B41J 29/38
(52) U.S. Cl. ..... 347/60; 347/14; 347/17
(58) Field of Search ..... 347/11, 14, 17, 347/60

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
5,477,246 A * 12/1995 Hirabayashi et al. ..... 347/17
6,019,448 A 2/2000 Yano et al.
6,260,940 B1 * 7/2001 Yamada et al. ..... 347/17
6,481,815 B1 * 11/2002 Nariai ..... 347/11

FOREIGN PATENT DOCUMENTS

JP 4-85045 3/1992

* cited by examiner

*Primary Examiner*—Thinh Nguyen
*Assistant Examiner*—Julian Huffman
(74) *Attorney, Agent, or Firm*—Fitzpatrick, Cella, Harper & Scinto

(57) ABSTRACT

Prompt ink-temperature control can be performed without increasing the capacity of a power supply. In an ink-jet recording apparatus performing recording by causing an ink-jet recording head for performing recording by discharging ink to perform scanning on a recording medium, the temperature of ink is raised to a predetermined temperature by applying a pulse so short as not to cause ink discharge to a discharge heater for discharging the ink, and using a sub-heater for heating the ink. Parameters (short-pulse conditions) of a short pulse to be applied to the discharge heater are changed in accordance with the states of operations of a carriage motor for causing the recording head to perform scanning, and a sheet feeding motor for conveying the recording medium.

16 Claims, 15 Drawing Sheets

INTERNALLY GENERATED PULSE 1
OFF
ON
PTT01
PTT00

INTERNALLY GENERATED PULSE 2
OFF
ON
PTT02

HEAT ENABLE
OFF
ON

FIG.13A

SHORT-PULSE HEATING CONDITION 1

| | | | |
|---|---|---|---|
| Fop | [30]KHz | PTT01 | [0.470]us |
| PTT02 | [0.939]us | PTT00 | [0.121]us |

FIG.13B

SHORT-PULSE HEATING CONDITION 2

| | | | |
|---|---|---|---|
| Fop | [15]KHz | PTT01 | [0.470]us |
| PTT02 | [0.939]us | PTT00 | [0.121]us |

FIG.14A

SHORT-PULSE HEATING CONDITION 1
BLACK AND WHITE

| | | | |
|---|---|---|---|
| Bk_Fop | [30]KHz | Bk_PTT01 | [0.470]us |
| Bk_PTT02 | [1.879]us | Bk_PTT00 | [0.182]us |

FIG.14B

COLOR

| | | | |
|---|---|---|---|
| Cl_Fop | [30]KHz | Cl_PTT01 | [0.470]us |
| Cl_PTT02 | [0.939]us | Cl_PTT00 | [0.121]us |

FIG.14C

SHORT-PULSE HEATING CONDITION 2
BLACK AND WHITE

| | | | |
|---|---|---|---|
| Bk_Fop | [15]KHz | Bk_PTT01 | [0.470]us |
| Bk_PTT02 | [1.879]us | Bk_PTT00 | [0.182]us |

FIG.14D

COLOR

| | | | |
|---|---|---|---|
| Cl_Fop | [15]KHz | Cl_PTT01 | [0.470]us |
| Cl_PTT02 | [0.939]us | Cl_PTT00 | [0.121]us |

INK-JET RECORDING APPARATUS, AND INK-TEMPERATURE CONTROL METHOD IN THE SAME

BACKGROUND OF THE INVENTION

1. Field of the Invention

The present invention relates to an ink-jet recording apparatus, and an ink-temperature control method in the same. More particularly, the invention relates to ink-temperature control in an ink-jet recording apparatus, which performs recording by causing an ink-jet recording head, for performing recording by discharging ink, to perform scanning on a recording medium.

2. Description of the Related Art

Printers that record information including desired characters, images and the like, on a sheet-shaped recording medium, such as paper, a film or the like, are widely being used as information output apparatuses in word processors, personal computers, facsimile apparatuses and the like.

Various recording methods for printers are known. Recently, attention is particularly paid to an ink-jet method, because, for example, non-contact recording can be performed on a recording medium, such as paper or the like, color printing can be easily performed, and silent printing can be performed. As for the configuration of ink-jet recording, a serial recording method, in which recording is performed by mounting a recording head for discharging ink in accordance with desired recording information and performing reciprocating scanning in directions orthogonal to a direction of feeding a recording medium, such as paper or the like, is being widely used because, for example, an inexpensive and small-size printer can be easily obtained.

Generally, the viscosity of ink used in ink-jet recording apparatuses increases in a low-temperature environment. As a result, in a low-temperature environment, phenomena such that the volume of ink discharged from a recording head decreases (variations in the amount of ink discharge), and normal ink discharge is not performed (a failure in ink discharge) occur.

In such a case, for example, unevenness in the density due to variations in the amount of ink discharge, and incomplete dot shapes due to a failure in ink discharge are observed in a recorded image, thereby greatly degrading the quality of recording.

Furthermore, if a volatile ink component evaporates in an ink channel provided near a discharge port of a recording head to increase the viscosity of ink, a failure in ink discharge tends to occur even after a few ink discharging operations.

In order to solve such variations in the amount of ink discharge and a failure in ink discharge, in conventional ink-jet recording apparatuses, control is performed by heating a recording head so that the temperature of the recording head is within a predetermined temperature range, before or during a recording operation.

The following two methods for heating a recording head are present. In a short-pulse heating method, discharge heaters for discharging ink droplets are heated with a pulse so short as not to cause ink discharge. In a sub-heater heating method, ink is directly or indirectly heated by providing a heat-retaining sub-heater separately from discharge heaters.

In any of the above-described methods, as a general temperature control sequence, short-pulse heating or sub-heater heating is performed until the temperature of the recording head reaches a target temperature, and heating is interrupted when the temperature of the recording head exceeds the target temperature.

However, the methods for controlling the temperature of the recording head applied to conventional ink-jet recording apparatuses have the following problems.

When a recording apparatus actually performs a recording operation, in addition to heating for temperature control, a CR (carriage) motor and an LF (line feeding) motor are driven for moving a carriage and an operation for feeding/discharging a recording medium, respectively.

Accordingly, in order to simultaneously perform heating of the recording head to a target temperature within a short time and driving of the CR motor and the LF motor, considerably large electric power is temporarily necessary, resulting in an increase in the required capacity of a power supply and an increase in the cost of the apparatus. On the other hand, in order to reduce power consumption in heating for temperature control, it is necessary to reduce the slope of a temperature rise profile of the recording head, resulting in an increase in the time required for reaching a target temperature and a decrease in throughput.

SUMMARY OF THE INVENTION

The present invention has been made in consideration of the above-described problems.

It is an object of the present invention to provide an ink-jet recording apparatus and an ink-temperature control method in the apparatus, in which prompt ink-temperature control can be realized without increasing the capacity of a power supply, and a high-quality image can be recorded.

According to one aspect of the present invention, an ink-jet recording apparatus that performs recording by causing an ink-jet recording head, for performing recording by discharging ink, to perform scanning on a recording medium includes temperature acquisition means for acquiring a temperature of the recording head, heating means, provided within the recording head, for performing temperature control of ink, driving means for driving the heating means in accordance with predetermined parameters, a first motor for causing the recording head to perform scanning, a second motor for conveying the recording medium, driving control means for controlling the driving means in accordance with an output from the temperature detection means, and parameter changing means for changing the parameters of the driving means in accordance with operational states of the first and second motors.

According to another aspect of the present invention, an ink-temperature control method in an ink-jet recording apparatus that performs recording by causing an ink-jet recording head, for performing recording by discharging ink, to perform scanning on a recording medium, including temperature acquisition means for acquiring a temperature of the recording head, heating means, provided within the recording head, for heating ink, driving means for driving the heating means in accordance with predetermined parameters, a first motor for causing the recording head to perform scanning, and a second motor for conveying the recording medium, includes a driving control step of controlling the driving means in accordance with an output from the temperature detection means, and a parameter changing step of changing the parameters of the driving means in accordance with operational states of the first and second motors.

That is, according to the present invention, in an ink-jet recording apparatus that performs recording by causing an ink-jet recording head, for performing recording by discharging ink, to perform scanning on a recording medium, including temperature detection means provided within the recording head, heating means, provided within the recording head, for heating ink, driving means for driving the heating means in accordance with predetermined parameters, a first motor for causing the recording head to perform scanning, and a second motor for conveying the recording medium, the driving means is controlled in accordance with an output from the temperature detection means, and the parameters of the driving means are changed in accordance with operational states of the first and second motors.

According to the above-described configuration, it is possible to change the parameters so that power consumption in the heating means is increased when neither of the first and second motors operates, and power consumption in the heating means is reduced when one of the first and second motors operates, and promptly control the temperature of ink within the range of the capacity of the power supply of the recording apparatus, in accordance with the operational states of the motors.

Accordingly, it is possible to suppress the maximum instantaneous power consumption, promptly control the temperature of ink without increasing the capacity of the power supply, and record a high-quality image by preventing the generation of unevenness in the density due to variations in the amount of ink discharge and incomplete dot shapes due to a failure in ink discharge.

The foregoing and other objects, advantages and features of the present invention will become more apparent from the following detailed description of the preferred embodiments taken in conjunction with the accompanying drawings.

BRIEF DESCRIPTION OF THE DRAWINGS

FIGS. 13A and 13B are diagrams illustrating short-pulse heating conditions in the first embodiment;

FIGS. 14A–14D are diagrams illustrating short-pulse heating conditions for color and black-and-white images in a second embodiment of the present invention;

DETAILED DESCRIPTION OF THE PREFERRED EMBODIMENTS

Preferred embodiments of the present invention will now be described in detail with reference to the drawings.

In the following embodiments, a description will be provided illustrating a printer as a recording apparatus using an ink-jet recording method.

In the description that follows, the word "recording" (also termed "print") indicates both a case in which information including characters, figures or the like is formed, and a case in which an image, a figure, a pattern or the like is formed on a recording medium, or the medium is processed, irrespective of whether a human being is capable of sensing the information or not.

In the description that follows, the word "recording medium" indicates both paper used in a conventional recording apparatus, and a substance that can receive ink, such as cloth, a plastic film, a metal plate, glass, ceramics, wood, leather or the like.

In the description that follows, the word "ink" (sometimes also termed a "liquid") is to be interpreted in context with the above-described definition of "recording (print)", and indicates a liquid that can be used for forming an image, a figure, a pattern or the like, processing a recording medium, or processing ink (for example, solidification or provision of insolubility of a color material within ink supplied to a recording medium).

First, a description will be provided of a color ink-jet recording apparatus to which an ink-temperature control method according to the present invention is suitably applied. In each of the following embodiments, a case of using a heater (a resistive element) as a recording element for discharging ink from the corresponding discharge port will be illustrated. However, an element other than a heater may also be used as the recording element.

(1) Entire Configuration

Figure 15:
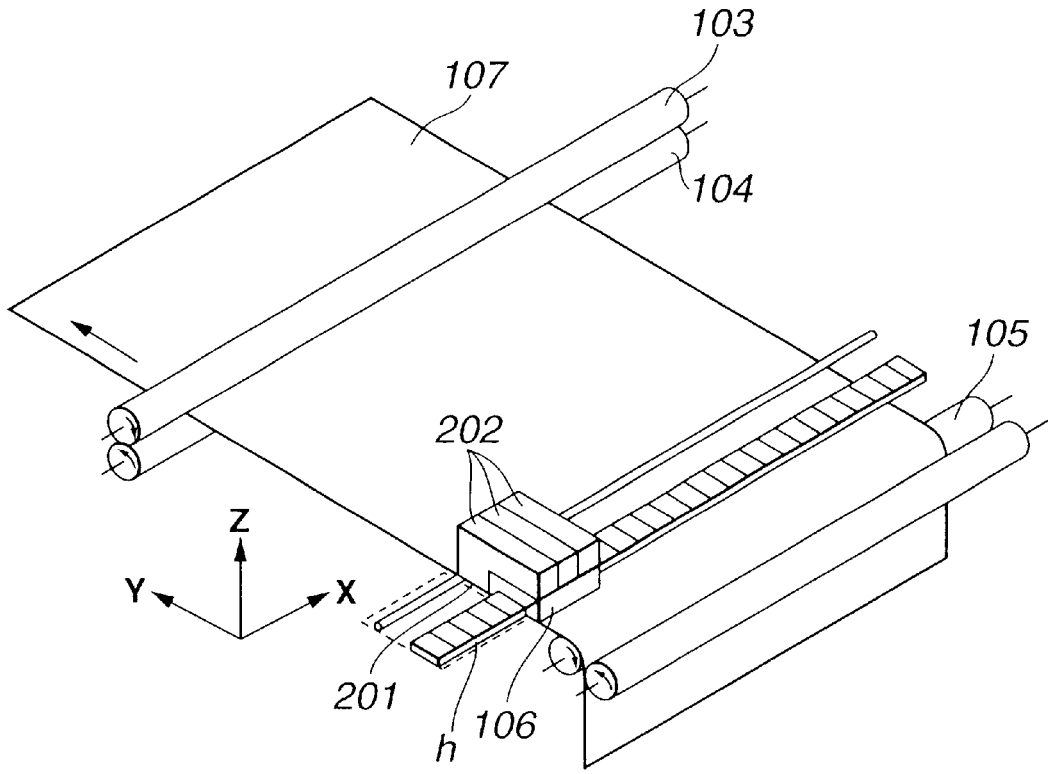
FIG. 15 is a schematic perspective view illustrating the configuration of a color ink-jet recording apparatus to which the present invention can be applied.

FIG. 15 is a schematic perspective view illustrating the entire configuration of a color ink-jet recording apparatus to which the present invention can be applied. In FIG. 15, an ink cartridge 202 includes ink tanks accommodating ink liquids of four colors (black, cyan, magenta and yellow), and a recording head 201. A sheet feeding roller 103 feeds recording paper 107, serving as a recording medium, by rotating in the direction of an arrow shown in FIG. 15 together with an auxiliary roller 104 while pressing the recording paper 107. A carriage 106 supports the ink cartridge 202, and moves the ink cartridge 202 and the recording head 201 in a recording operation. The carriage 106 is controlled so as to wait at a home position indicated by broken lines in FIG. 15, when the recording apparatus is not performing recording or performs a recovery operation for the recording head 201.

Upon reception of an instruction to start recording, the carriage 106 located at the position (home position) shown in FIG. 15 before starting recording performs recording on a region corresponding to the width of recording of the recording head 201 on the recording paper 107 by driving recording elements provided in the recording head 201 while moving in the x direction. Upon completion of recording to an end portion of the recording paper 107 along the scanning direction of the carriage 106, the carriage 106 returns to the home position to again perform recording in the x direction. Before starting subsequent recording scanning after completing the preceding recording scanning, the sheet feeding roller 103 rotates in the direction of the arrow shown in FIG. 15 to perform sheet feeding by a necessary width in the y direction. By thus alternately repeating main scanning and sheet feeding for recording, recording on the recording paper 107 is completed. A recording operation of discharging ink from the recording head 201 is performed based on control from recording control means (not shown).

In order to increase the recording speed, instead of performing recording only at main scanning in one direction, recording may also be performed at a return path in which the carriage 106 is returned to the home position after performing recording at main scanning in the x direction.

Although in the foregoing description, the ink tanks for accommodating ink liquids for recording and the recording head 201 for discharging ink toward the recording paper 107 are integrated as the ink cartridge 202, the ink tanks and the recording head 201 may be separably held in the carriage 106. Furthermore, a plural-color integrated recording head (a color recording head) in which ink liquids of a plurality of colors can be discharged from a single recording head may also be used.

At a position for performing the above-described recovery operation, capping means (not shown) for capping the front surface (discharge-port surface) of the recording head 201, and a recovery unit (not shown) for performing a head recovery operation of removing, for example, ink having increased viscosity and bubbles within the recording head 201 are provided. At a side of the capping means, a cleaning blade (not shown) or like is supported so as to be able to protrude toward the recording head 201, to allow contact with the front surface of the recording head 201. According to this configuration, after the recovery operation, the cleaning blade is protruded in a moving path of the recording head 201, so that unnecessary ink droplets, stain and the like at the front surface of the recording head 201 are wiped in accordance with the movement of the recording head 201.

(2) Recording Head

Figure 16:
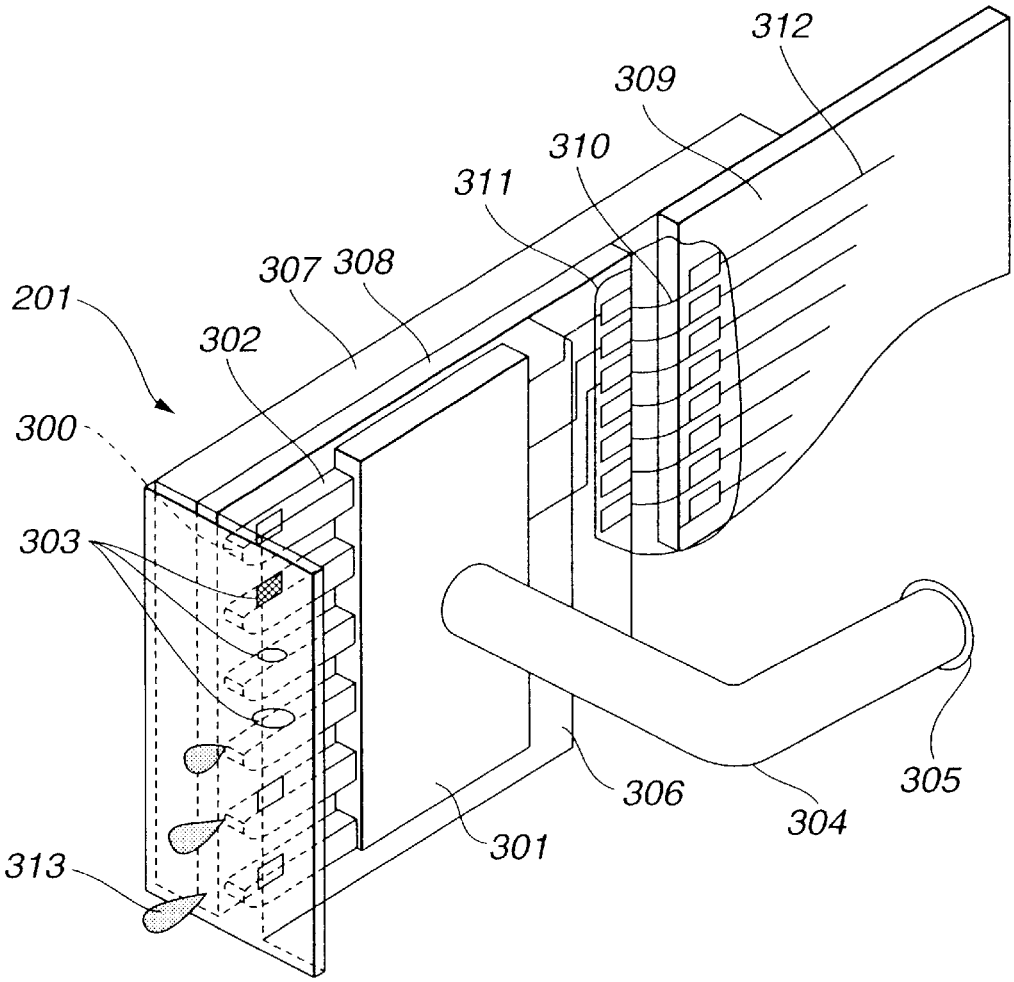
FIG. 16 is a fragmentary sectional perspective view illustrating a principal portion of a recording head shown in FIG. 15.

Next, the recording head 201 will be described with reference to FIG. 16. FIG. 16 is a fragmentary sectional perspective view illustrating a principal portion of the recording head 201 shown in FIG. 15.

As shown in FIG. 16, in the recording head 201, a plurality of discharge ports 300 are formed at a predetermined pitch, and recording elements 303 for generating energy for ink discharge are arranged along wall surfaces of respective liquid channels 302 connecting a common liquid chamber 301 to the corresponding discharge ports 300. The recording elements 303 and circuitry for them are formed on a silicon substrate utilizing a semiconductor manufacturing technique. A temperature sensor (not shown) and a sub-heater (not shown) are also formed on the same silicon substrate according to the same processing as the semiconductor manufacturing process.

A silicon plate 308 having electric wires formed thereon is bonded on a heat-radiating aluminum base plate 307. A circuit connection portion 311 on the silicon plate 308 and a printed circuit board 309 are connected using ultrafine wires 310, and a signal from the main body of the recording apparatus is received via a signal circuit 312. The liquid channels 302 and the common liquid chamber 301 constitute a plastic cover 306 formed according to injection molding.

The common liquid chamber 301 is connected to the ink tanks via a joint pipe 304 and an ink filter 305, so that ink is supplied to the common liquid chamber 301 from each of the ink tanks. Ink supplied from the ink tank to the common chamber 301 and temporarily stored therein penetrates into the liquid channels 302 by a capillary phenomenon, and fills the liquid channels 302 by forming a meniscus at the discharge ports 300.

When electric current is supplied to a recording element 303 via an electrode (not shown) in this state, ink around the recording element 303 is abruptly heated to generate a bubble within the liquid channel 302, and an ink droplet 313 is discharged from the corresponding discharge port 300 due to expansion of the bubble.

Although not illustrated, a temperature detection element for outputting information relating to the temperature of ink within the recording head 201 is provided at the common liquid chamber 301 or the liquid channel 302.

(3) Explanation of the Configuration of Control

Figure 17:
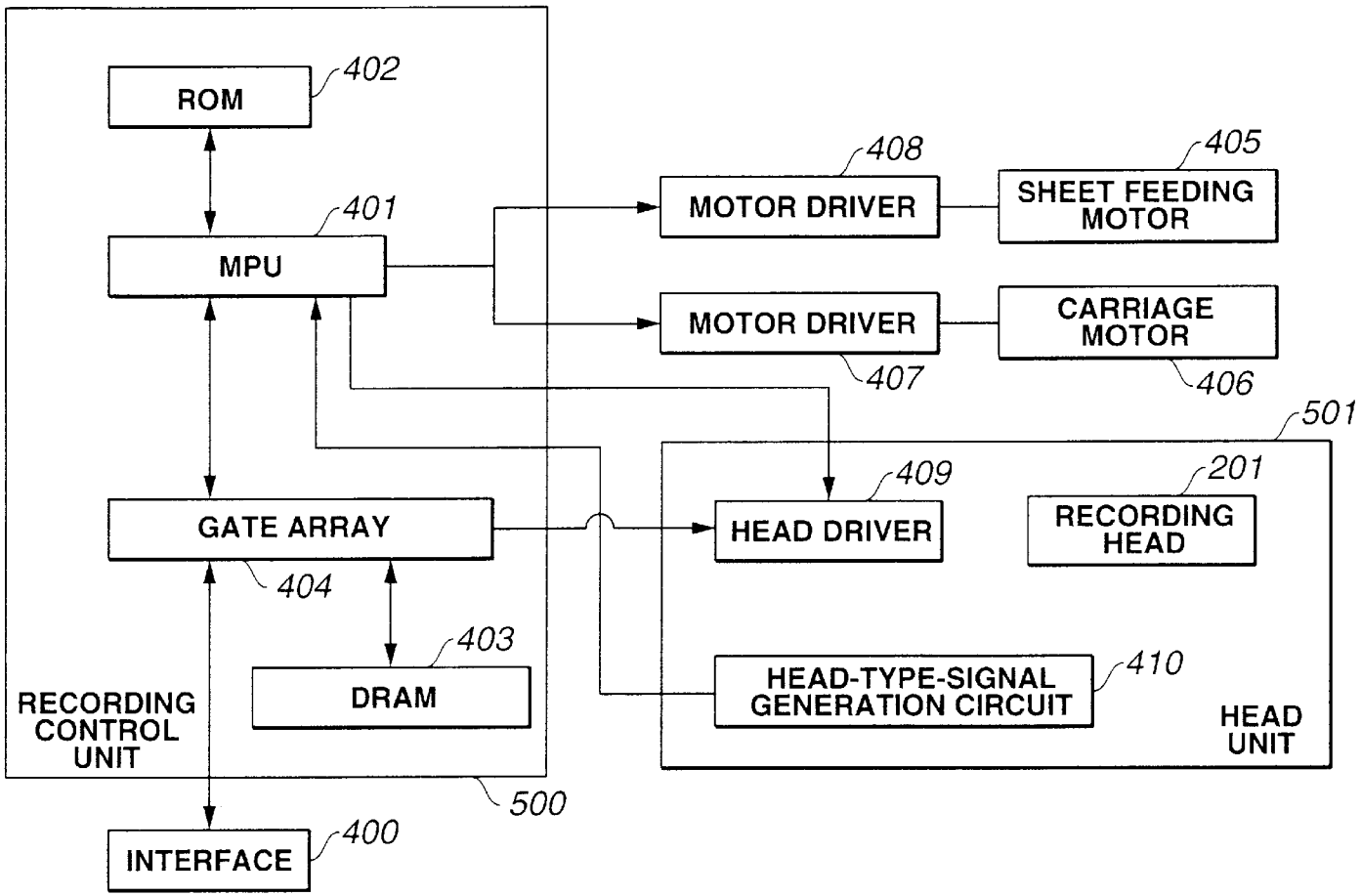
FIG. 17 is a block diagram illustrating control in the ink-jet recording apparatus shown in FIG. 15.

Next, a description will be provided of the configuration of control for executing recording control for each unit of the apparatus with reference to the block diagram shown in FIG. 17.

In FIG. 17, a recording control unit 500 includes an interface 400 for receiving a recording signal, an MPU (microprocessor unit) 401, a program ROM (read-only memory) 402 storing control programs to be executed by the MPU 401, and a RAM (random access memory) (DRAM (dynamic RAM)) 403 for storing various data (the recording signal, recording data to be supplied to the recording head 201, and the like). The RAM 403 can also store the number of recording dots, the frequency of exchange of ink recording heads, and the like. A gate array 404 controls supply of recording data for the recording head 201, as well as data transfer with the interface 400, the MPU 401 and the DRAM 403.

There are also shown a sheet feeding motor (LF motor) 405 for conveying recording paper, and a carriage motor (CR motor) 406 for conveying the recording head 201. Motor drivers 407 and 408 drive the CR motor 406 and the CR motor 405, respectively. These motor drivers 407 and 408 drive the corresponding motors in accordance With instructions from the MPU 401.

A head unit 501 includes a head driver 409 for driving the recording head 201, and a head-type-signal generation circuit 410 for generating a signal for determining the type (color, monochromic or the like) of the recording head 201.

Although not illustrated, a signal from a temperature detection element provided within the recording head 201 is input to the MPU 401.

A description will now be provided of respective embodiments of the ink-temperature control method in the ink-jet recording apparatus having the above-described configuration.

[First Embodiment]

In a first embodiment of the ink-temperature control method, parameters of a short pulse applied to a discharge heater are switched when the CR motor or the LF motor is driven and not driven.

(Short-Pulse Heating)

In the first embodiment, as temperature control by the discharge heater, ink around the discharge heater is directly heated by applying a driving signal whose pulse width is so small as not to generate a bubble in the discharge heater driven for ordinary ink discharge (short-pulse heating).

Figures 1A, 1B, 1C:
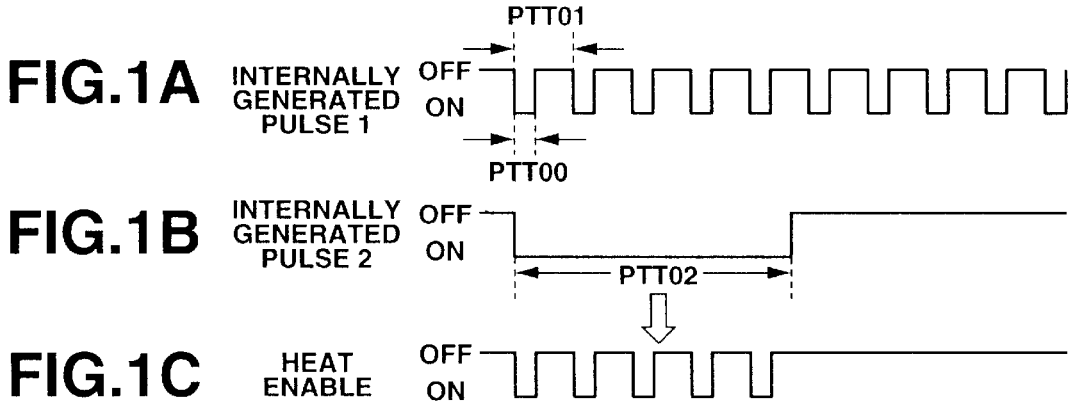
FIGS. 1A–1C are diagrams illustrating short pulses used in a first embodiment of the present invention.

FIGS. 1A–1C are diagrams, each illustrating a short pulse used in the first embodiment. An internally generated pulse 1 shown in FIG. 1A is a periodic pulse generated in accordance with a driving period (PTT01) and a driving duty ratio (PTT00) that have been set. An internally generated pulse 2 shown in FIG. 1B is generated in accordance with setting of a driving period (PTT02) within a time for each block. By obtaining a logical product of the two pulses, i.e., the internally generated pulses 1 and 2, a synthesized pulse shown in FIG. 1C is supplied to the recording head as a heat pulse (HEAT ENABLE).

Figure 2:
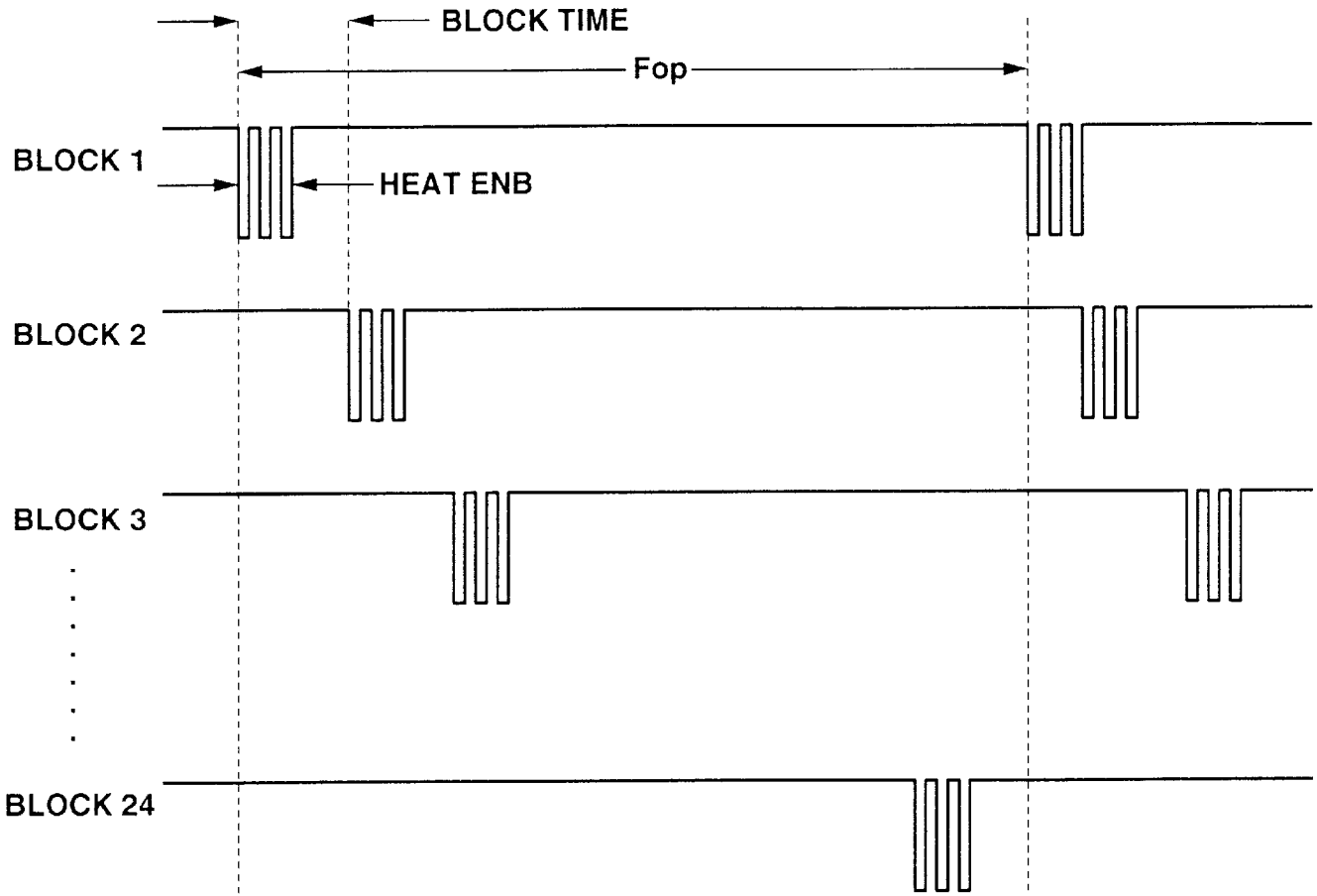
FIG. 2 is a diagram illustrating the relationship among a driving frequency, a driving time period for each block, and heat pulses in the first embodiment.

In the recording head in the first embodiment, all heaters are divided into 24 blocks, and each of the blocks is subjected to time-division driving. Accordingly, by setting a driving frequency, the period for driving each heater is determined. FIG. 2 illustrates the relationship among the driving frequency (Fop), a block time, i.e., a driving time for each block, and a heat pulse (HEAT ENABLE) applied to each block.

FIGS. 13A and 13B are diagrams, each illustrating an example of parameters of a short pulse (a short-pulse heating condition) in the first embodiment. A short-pulse heating condition 1 shown in FIG. 13A is a heating condition when none of the CR motor and the LF motor are driven, and a short-pulse heating condition 2 shown in FIG. 13B is a heating condition when the CR motor or the LF motor is driven. As shown in FIGS. 13A and 13B, in the first embodiment, a heating condition can be easily changed only by changing the driving frequency.

Whether or not a bubble is generated by a pulse applied to a discharge heater is determined by conditions, such as the resistance value of the heater, the driving voltage, and the like. Accordingly, heating conditions when a short pulse is used are not limited to the conditions shown in FIGS. 13A and 13B. It is desirable to drive the discharge heater with an optimum pulse condition not to generate a bubble, in accordance with the recording head, the power-supply voltage of the recording apparatus, and the like.

(Sub-Heater Heating)

Figure 3:
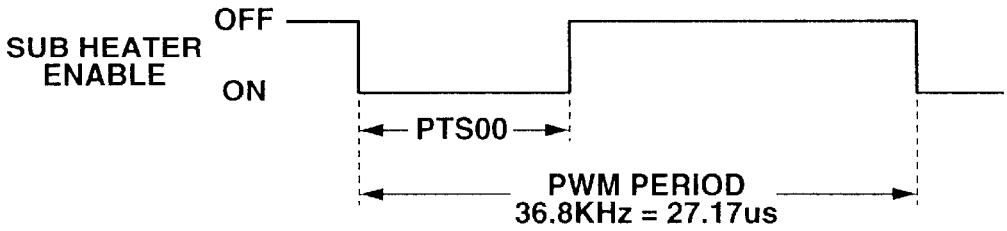
FIG. 3 is a diagram illustrating a driving pulse used for heating by a sub-heater in the first embodiment.

In the first embodiment, in addition to temperature control by a discharge heater, temperature control by a sub-heater dedicated for temperature control, provided separately from the discharge heater (sub-heater heating) is also performed. FIG. 3 is a diagram illustrating a driving pulse used for sub-heater heating. The sub-heater heating is performed by setting a pulse width (PTS00) corresponding to a heating period in a PWM (pulse-width modulation) period (27.17 $\mu$s in the first embodiment). Since power consumption is relatively small in the sub-heater used in the first embodiment, the pulse width is set to 27.045 $\mu$s.

The PWM period and the pulse width are not limited to the above-described values, but may desirably have optimum values in accordance with the performance of the sub-heater, the shape of the recording head, and the like.

(Temperature-Control Sequence)

Next, a description will be provided of a temperature-control sequence in which the temperature control of ink according to the first embodiment is executed by the MPU in accordance with each operation. In the following description, the target temperature of ink within the recording head is 38° C.

Figure 4:
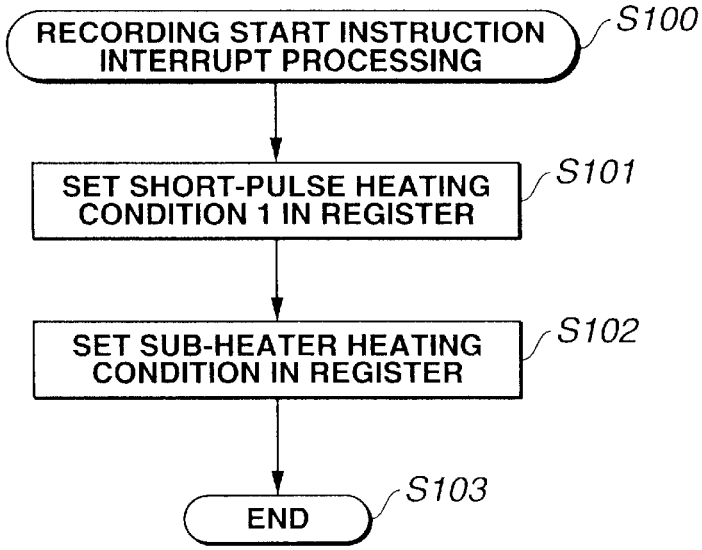
FIG. 4 is a flowchart illustrating processing when an instruction to start recording is received, in the first embodiment.

FIG. 4 is a flowchart illustrating processing when an instruction to start recording is received. Upon reception of an instruction to start recording, recording start instruction interrupt processing is started (step S100), and various parameters of the short-pulse heating condition 1 are set in a register (step S101). Then, the sub-heater heating condition is set in the register (step S102), and the interrupt processing is terminated (step S103). According to this processing, when temperature control is necessary (when the temperature is equal to or less than 30° C.) in the subsequent processing, the temperature control is performed according to the conditions set in the register.

Figure 5:
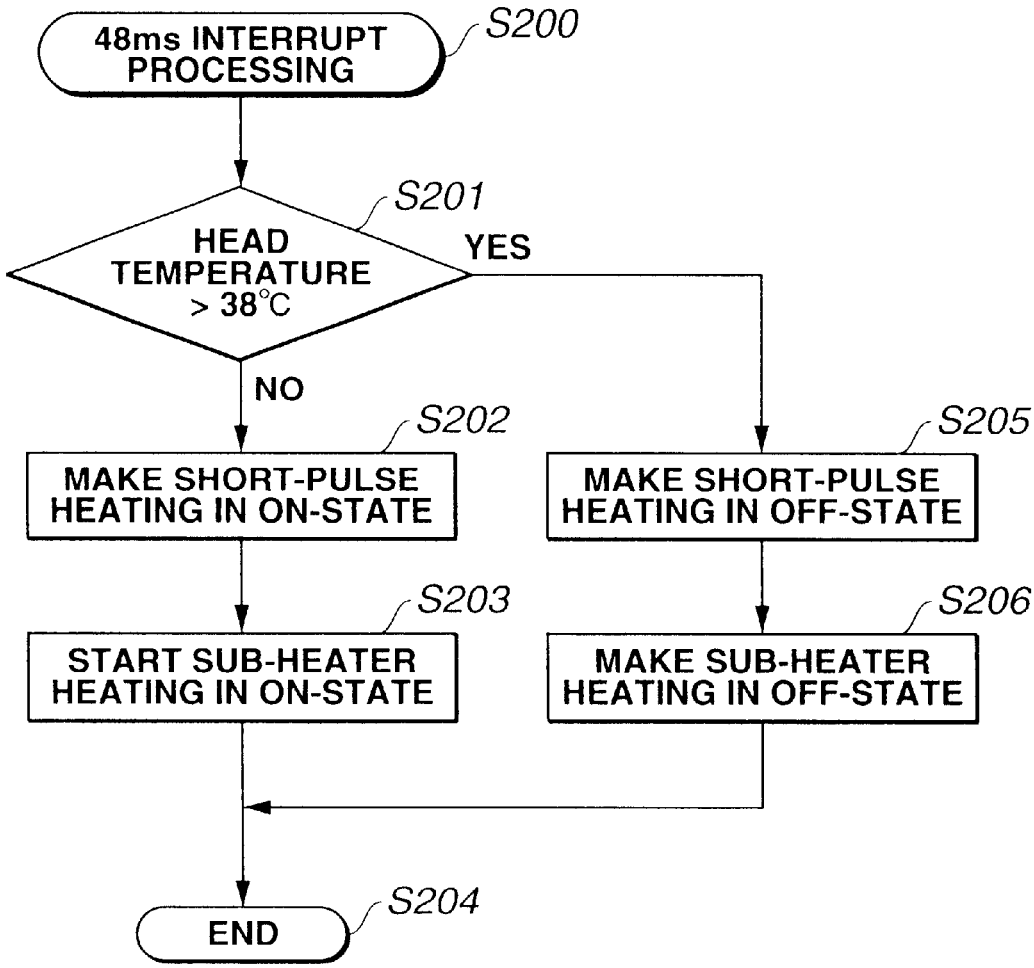
FIG. 5 is a flowchart illustrating timer interrupt processing in the first embodiment.

FIG. 5 is a flowchart illustrating timer interrupt processing with an interval of 40 ms for determining whether or not temperature control is necessary. This processing is periodically performed until a predetermined time period elapses after completing recording upon reception of an instruction to start recording.

Upon start of interrupt processing by a timer within the MPU (step S200), the temperature of ink within the recording head is obtained based on a signal from the temperature control element, and it is determined whether or not the temperature exceeds the target temperature (38° C.) (step S201). If the result of the determination in step S201 is negative, short-pulse heating is made in an on-state (step S202), sub-heater heating is made in an on-state (step S203), and the interrupt processing is terminated (step S204).

If the result of the determination in step S201 is affirmative, short-pulse heating is made in an off-state (step S205), sub-heater heating is made in an off-state (step S206), and the interrupt processing is terminated (step S204).

Figure 6:
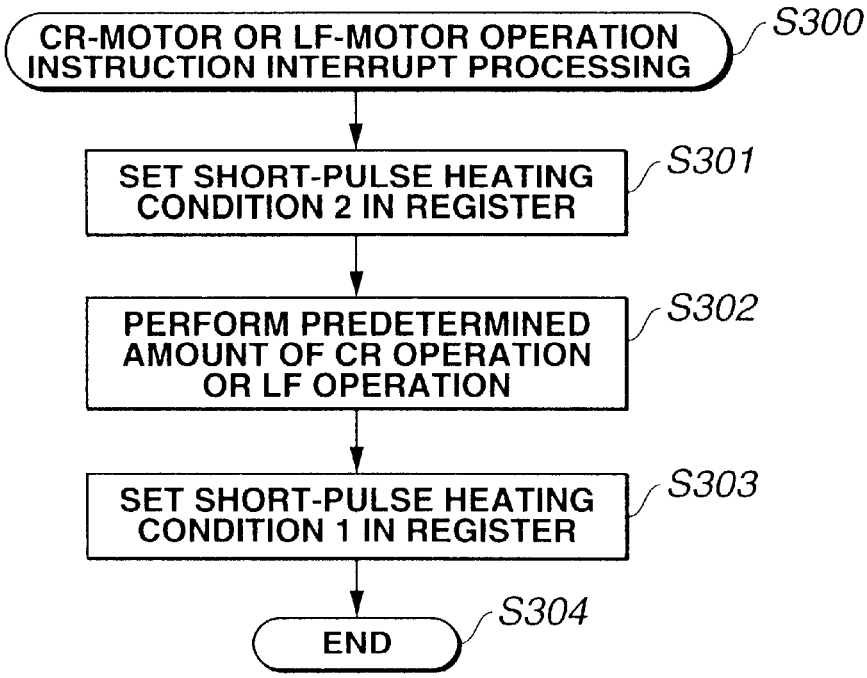
FIG. 6 is a flowchart illustrating interrupt processing started in response to an operation instruction for a CR motor or an LF motor in the first embodiment.

FIG. 6 is a flowchart illustrating interrupt processing started in response to an instruction of operation for the CR motor or the LF motor.

Upon start of interrupt processing in response to an instruction for a CR operation or an LF operation (step S300), the short-pulse heating condition 2 is set in the register (step S301). Then, a predetermined amount of CR operation or LF operation is performed (step S302). When temperature control is necessary during the CR operation or the LF operation (when the temperature is equal to or less than 38° C.), short-pulse heating is performed with the short-pulse heating condition 2. Finally, the short-pulse heating condition 1 is set in the register upon completion of the CR operation or the LF operation (step S303), and the interrupt processing is terminated (step S304).

Figure 7:
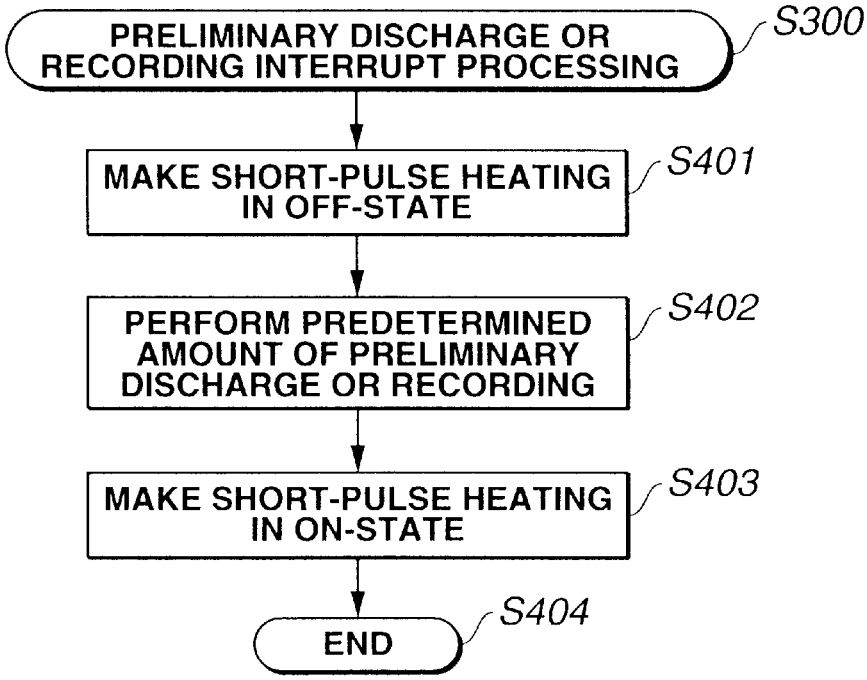
FIG. 7 is a flowchart illustrating interrupt processing started in response to preliminary ink discharge or a recording operation in the first embodiment.

FIG. 7 is a flowchart illustrating interrupt processing started in response to preliminary ink discharge or a recording operation.

Upon start of interrupt processing in response to an instruction for preliminary ink discharge or a recording operation (step S400), short-pulse heating is made in an off-state (step S401), because of the following reason. That is, since short-pulse heating is performed using the discharge heater, it is difficult to simultaneously perform ink discharge and heating. A predetermined amount of preliminary ink discharge or recording is performed in accordance with the instruction (step S402). Upon completion of the preliminary ink discharge or the recording, short-pulse heating is made in an on-state (step S403), and the interrupt processing is terminated (step S404).

Figure 8:
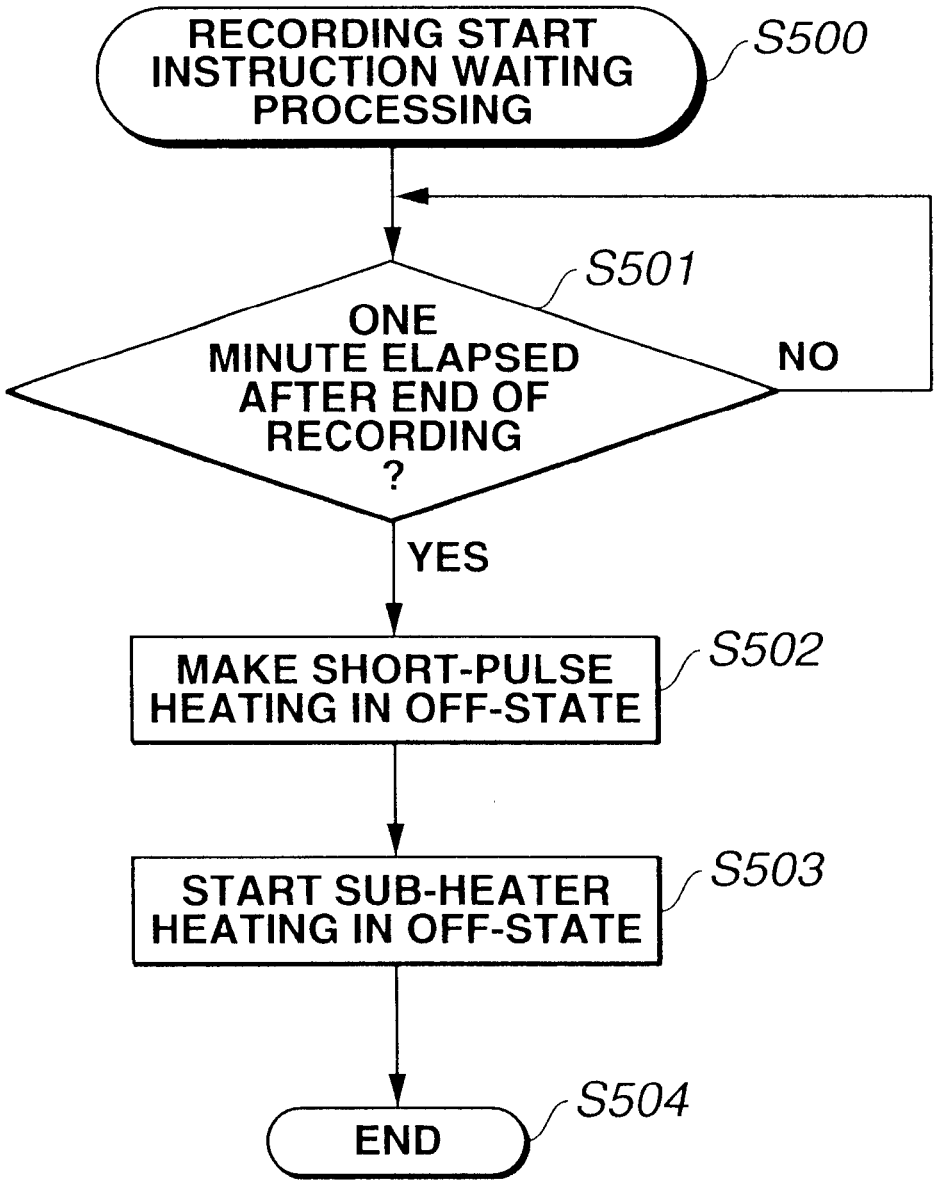
FIG. 8 is a flowchart illustrating processing performed when awaiting an instruction to start recording in the first embodiment.

FIG. 8 is a flowchart illustrating processing performed while awaiting an instruction to start recording. In the first embodiment, assuming a case in which the subsequent instruction to start recording is consecutively generated after recording predetermined recording data, the carriage is maintained in a waiting state for one minute, so as to instantaneously start recording when an instruction to start recording is generated.

Processing is started when a waiting state is provided after completing a recording operation (step S500), and it is determined whether or not one minute has elapsed after completing recording (step S501). If the result of the determination in step S501 is affirmative, short-pulse heating is made in an off-state (step S502), sub-heater heating is also made in an off-state (step S503), and the processing is terminated by returning the carriage to the home position and closing the protective cap (step S504).

Figure 11:
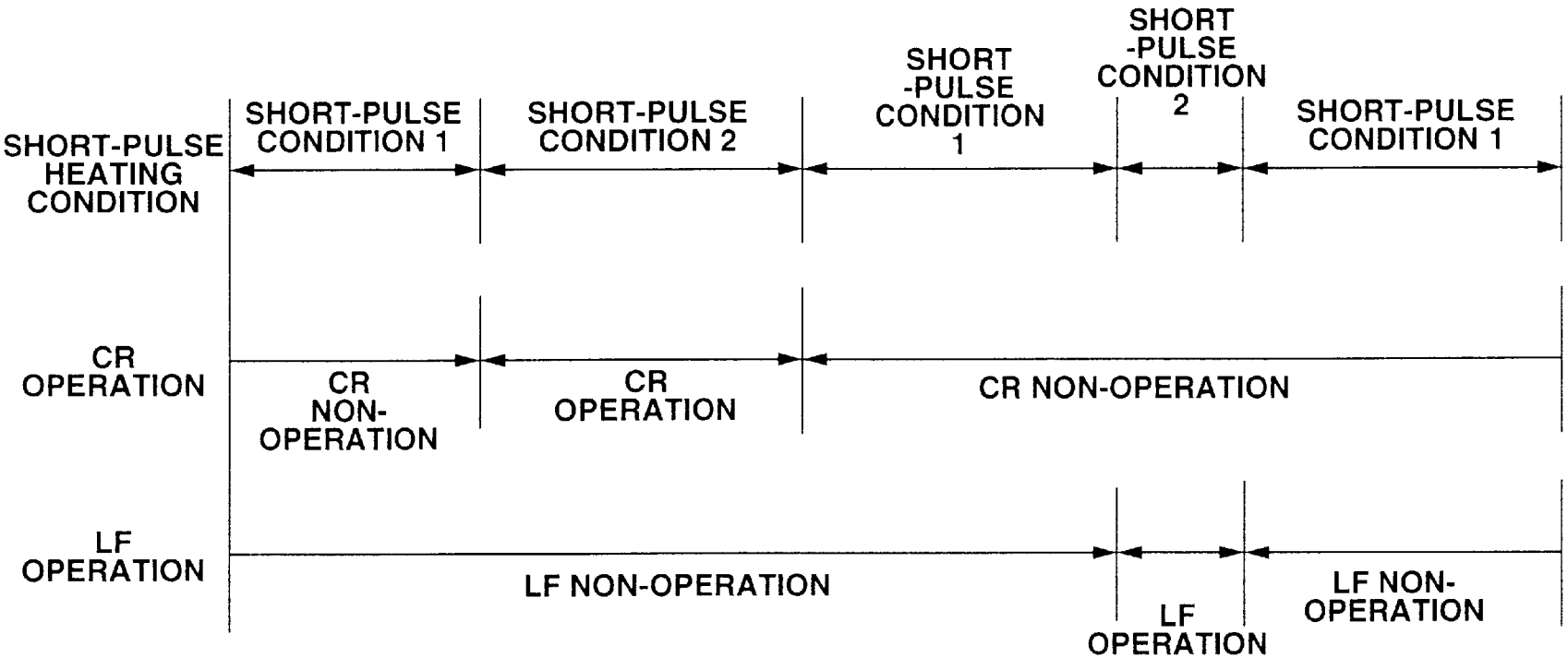
FIG. 11 is a schematic diagram illustrating a manner in which a short-pulse heating condition is switched in the first embodiment.

FIG. 11 is a schematic diagram illustrating how the short-pulse heating condition is switched. As shown in FIG. 11, the recording head is driven with the short-pulse heating condition 1 having large power consumption when none of the LF operation and the CR operation are performed. When the CR operation or the LF operation is performed, the recording head is driven with the short-pulse heating condition 2 whose power consumption is about half the power consumption in the short-pulse heating condition 1 in synchronization with the CR operation or the LF operation.

In general, temperature control is required when the temperature of the environment of the recording apparatus is low and recording is not performed for a long time. Accordingly, while preparation for start of recording is performed after receiving an instruction to start recording, large thermal energy is necessary in order to raise the temperature of ink within the recording head. After starting recording, since ink within the recording head has once reached a target temperature, so much thermal energy is not required even if the duty ratio of recording data is low.

The time period of operation of each of the CR motor and the LF motor is not so long in a preparatory stage to start recording. Accordingly, even if the time period of current supply to the discharge heater is suppressed to about a half value only while the CR motor or the LF motor is operating, the temperature profile of ink is not so much influenced, and the temperature of the head can reach a target temperature in a very short time.

As described above, according to the first embodiment, ink within the recording head is heated using both of the discharge heater and the sub-heater, and a parameter (the period) of a driving signal (a short-pulse signal) for short-pulse heating to be applied to the discharge heater is switched between a case in which one of the CR operation and the LF operation is performed and a case in which none of the CR operation and the LF operation are performed. It is thereby possible to promptly control the temperature of ink while suppressing an instantaneous increase in power consumption, and suppress an increase in the size and the cost of the power supply. It is also possible to cause ink within the recording head to reach a target temperature in a short time, and record a high-quality image that does not have unevenness in the density and incomplete dot shapes, while shortening the time period necessary for preparation for start of recording.

[Second Embodiment]

A description will now be provided of a second embodiment of the ink-temperature control method in the ink-jet recording apparatus of the invention. In the second embodiment, description about the same portions as in the first embodiment will be omitted, and characteristic portions of the second embodiment will be mainly described.

In the second embodiment, when the size of a heater and the number of nozzles differ between a black-and-white recording bead and a color recording bead of an ink-jet recording apparatus, prompt ink-temperature control can be performed by setting optimum parameters (beating condition) for each of the recording heads.

(Ink and a Pulse Width)

In general, most ink-jet recording apparatuses use ink liquids of different types for black-and-white recording and color recording. For example, addition-type ink including a pigment or the like is used as black ink, and penetration-type ink including a dye or the like is used as color ink. It is thereby possible to improve the quality of black characters, and prevent bleeding between different color ink liquids.

In a recording apparatus using such an ink system, the amount of ink discharge necessary for recording of dots differs between black ink and color ink. As a result, the configuration of a recording head, such as the size of a heater, the number of nozzles, and the like, differs. In general, in a recording head for black-and-white recording, since the amount of ink discharge is larger for black ink than for color ink, the size of a heater is larger and energy necessary for generating a bubble is also larger. Accordingly, when the supplied power-supply voltage is the same, the width of a heating pulse for temperature control so short as not to generate a bubble differs, such that the width of a pulse applied to a black recording head must be longer than the width of a pulse applied to a color recording head.

(Heating Condition)

FIGS. 14A–14D are diagrams illustrating examples of parameters of respective short-pulse heating conditions for a black-and-white-image recording head and a color-image recording head, similar to FIGS. 13A and 13B. Short-pulse heating conditions 1 shown in FIGS. 14A and 14B are heating conditions when neither of the CR motor and the LF motor is driven, and short-pulse heating conditions 2 shown in FIGS. 14C and 14D are heating conditions when the CR motor or the LF motor is driven. As shown in FIGS. 14A–14D, in the second embodiment, as in the first embodiment, a heating condition can also be easily changed by changing only the driving frequency.

The heating conditions of FIGS. 14B and 14D for a color-image recording head are the same as the heating conditions of FIGS. 13A and 13B in the first embodiment. In parameters of the heating conditions for a black-and-white-image recording head, the driving duty cycle PTT00 and the driving period PTT02 are set to be longer than in the heating conditions for a color-image recording head.

A sub-heater heating condition in the second embodiment is the same as in the first embodiment, and is constant irrespective of the driving states of the CR motor and the LF motor.

(Temperature Sequence)

A temperature sequence in the second embodiment is similar to the temperature sequence in the first embodiment. A short-pulse heating condition may be set separately for a black-and-white-image recording head and a color-image recording head.

As described above, according to the second embodiment, by setting an optimum heating condition for each of a black-and-white-image recording head and a color-image recording head, prompt ink-temperature control can be performed even in an ink-jet recording apparatus having different configurations for a black-and-white-image recording head and a color-image recording head.

[Third Embodiment]

A description will now be provided of a third embodiment of the ink-temperature control method in the ink-jet recording apparatus of the invention. In the third embodiment, description about the same portions as in the first and second embodiments will be omitted, and characteristic portions of the third embodiment will be mainly described.

In the third embodiment, heating conditions are more finely classified, such that different short-pulse heating conditions are provided for four cases, i.e., a case in which neither of the LF operation and the CR operation is performed, a case in which only the LF operation is performed, a case in which only the CR operation is performed, and a case in which both of the LF operation and the CR operation are performed.

It is thereby possible to perform optimum temperature control in accordance with the capacity of the power supply by setting a short-pulse heating condition in accordance with power consumption of the CR motor and the LF motor. As a result, it is possible to perform prompt ink-temperature control even in an ink-jet recording apparatus in which the CR operation and the LF operation are simultaneously performed.

(Heating Condition)

In four short-pulse heating conditions in the third embodiment, the driving frequency is switched. Other conditions are the same as in the first embodiment. Driving frequencies for respective heating conditions are:

- short-pulse heating condition 1 (CR operation absent, LF operation present absent): 30 kHz;
- short-pulse heating condition 2 (CR operation present, LF operation absent): 22.5 kHz;
- short-pulse heating condition 3 (CR operation present, LF operation present): 7.5 kHz;
- short-pulse heating condition 4 (CR operation absent, LF operation present): 15 kHz.

A sub-heater heating condition in the third embodiment is the same as in the first embodiment, and is constant irrespective of the driving states of the CR motor and the LF motor.

(Temperature Sequence)

In the third embodiment, the short-pulse heating condition is switched by determining whether or not the CR motor or the LF motor is operating when starting and terminating the operation of driving of the LF motor or the CR motor, respectively.

Figure 9:
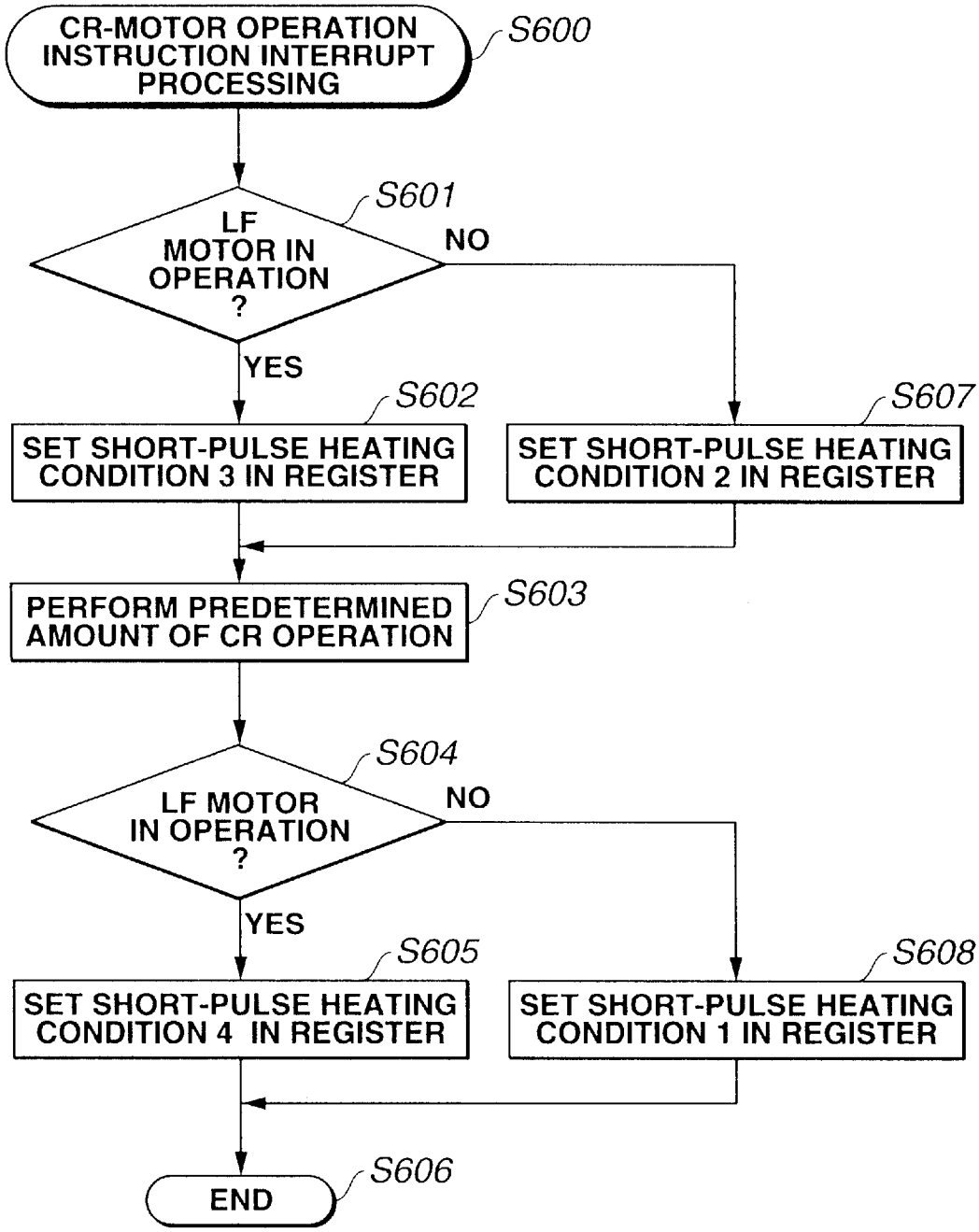
FIG. 9 is a flowchart illustrating operation-instruction interrupt processing for a CR motor in a third embodiment of the present invention.

FIG. 9 is a flowchart illustrating CR-motor operation instruction interrupt processing. Upon start of interrupt processing in response to a CR-motor operation instruction (step S600), it is determined whether or not the LF motor is in operation (step S601). If the result of the determination in step S601 is affirmative, the short-pulse heating condition 3 is set in a register (step S602). If the result of the determination in step S601 is negative, the short-pulse heating condition 2 is set in the register (step S607).

Then, a predetermined amount of driving of the CR motor is performed (step S603). If the driving of the CR motor overlaps with driving of the LF motor, heating is performed with the short-pulse heating condition 3 having lowest power consumption. Upon completion of the driving of the CR motor, it is determined whether or not the LF motor is in operation (step S604). If the result of the determination in step S604 is affirmative, the short-pulse heating condition 4 is set in the register (step S605). If the result of the determination in step S604 is negative, the short-pulse heating condition 1 is set in the register (step S608). If the LF operation is not performed, heating is performed with the short-pulse heating condition 1 having highest power consumption.

Figure 10:
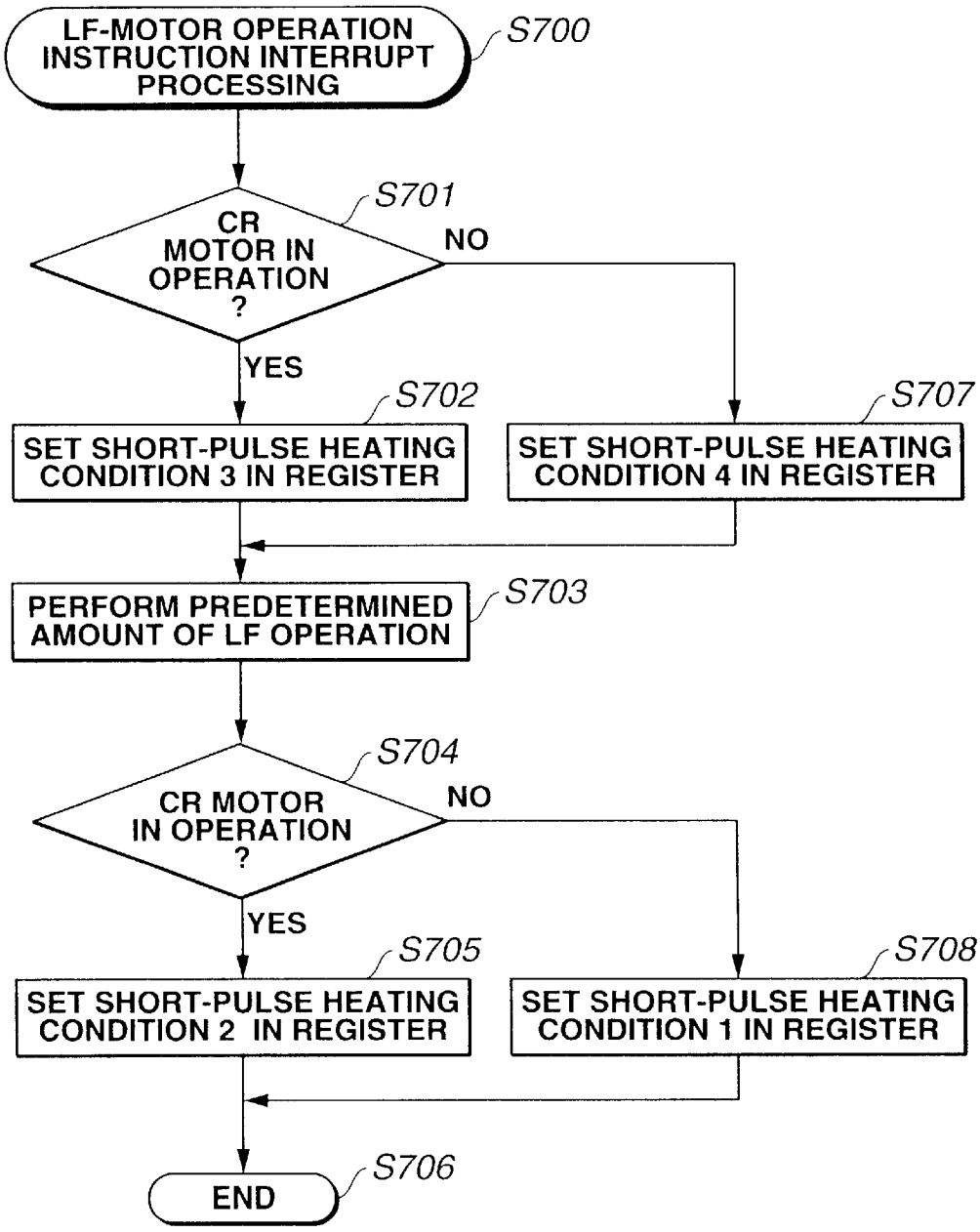
FIG. 10 is a flowchart illustrating operation-instruction interrupt processing for an LF motor in the third embodiment.

FIG. 10 is a flowchart illustrating LF-motor operation instruction interrupt processing. Upon start of interrupt processing in response to an LF-motor operation instruction (step S700), it is determined whether or not the CR motor is in operation (step S701). If the result of the determination in step S701 is affirmative, the short-pulse heating condition 3 is set in the register (step S702). If the result of the determination in step S701 is negative, the short-pulse heating condition 4 is set in the register (step S707).

Then, a predetermined amount of driving of the LF motor is performed (step S703). If the driving of the LF motor overlaps with driving of the CR motor, heating is performed with the short-pulse heating condition 3 having lowest power consumption. Upon completion of the driving of the LF motor, it is determined whether or not the CR motor is in operation (step S704). If the result of the determination in step S704 is affirmative, the short-pulse heating condition 2 is set in the register (step S705). If the result of the determination in step S704 is negative, the short-pulse heating condition 1 is set in the register (step S708). If the CR operation is not performed, heating is performed with the short-pulse heating condition 1 having highest power consumption.

Figure 12:
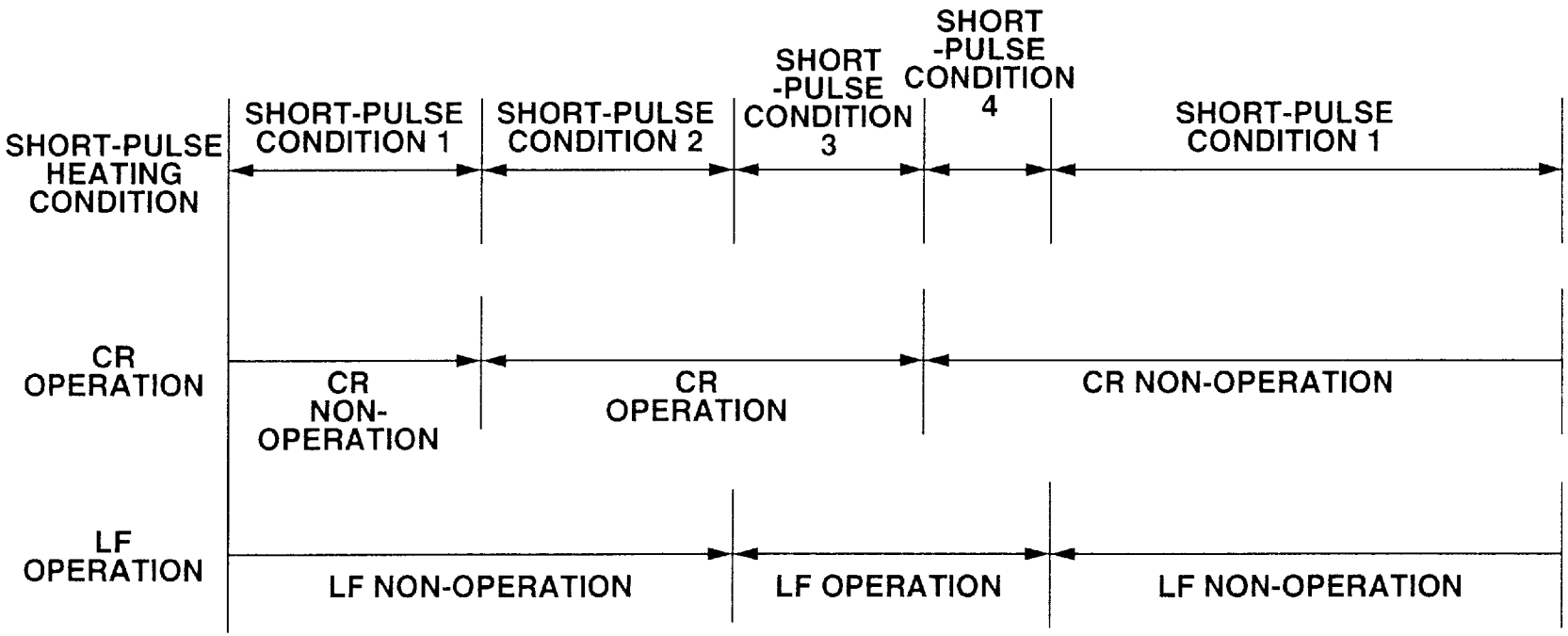
FIG. 12 is a diagram illustrating a manner in which a short-pulse heating condition is switched in the third embodiment.

FIG. 12 is a schematic diagram illustrating how the short-pulse heating condition is switched in the third embodiment. As shown in FIG. 12, the recording head is driven with the short-pulse heating condition 1 having highest power consumption when neither of the LF operation and the CR operation is performed. When only the CR operation is performed, the recording head is driven with the short-pulse heating condition 2 in synchronization with the CR operation. When only the LF operation is performed, the recording head is driven with the short-pulse heating condition 4 in synchronization with the LF operation. When both of the LF operation and the CR operation are performed, the recording head is driven with the short-pulse heating condition 3 having lowest power consumption.

As described above, according to the third embodiment, by changing the short-pulse heating condition in accordance with a combination of the CR operation and the LF operation, it is possible to promptly perform ink-temperature control without increasing the capacity of the power supply, and record a high-quality image not having unevenness in the density and incomplete dot shapes, even in a high-throughput ink-jet recording apparatus in which both of the CR operation and the LF operation are simultaneously performed.

[Other Embodiments]

In the foregoing first through third embodiments, only the short-pulse heating condition is changed in accordance with the CR operation and the LF operation. However, when using a recording head mounting a sub-heater having large power consumption, the driving condition for the sub-heater may be changed.

In general, the resistance values of the discharge heaters and the sub-heater vary due to variations in the process for manufacturing recording heads. As a result, the time period necessary for temperature control also varies. Accordingly, an optimum heating condition (parameters) may be set in accordance with a ranked value of the heaters of the mounted recording head, for example, by ranking variations of the heater resistance values of the recording head.

In the above-described embodiments, heaters (resistive elements) are used as recording elements for discharging ink droplets from corresponding discharge ports. However, the present invention may also be applied to a configuration in which elements other than heaters are used as recording elements, and a heater for heating ink is separately provided. In this case, driving parameters for a heater for heating ink are switched in accordance with the operational states of the CR motor and the LF motor.

The above-described embodiments can achieve high-density and very precise recording particularly by using a method, from among ink-jet recording methods, which includes means for generating thermal energy as energy to be utilized for discharging ink (for example, electrothermal transducers, a laser beam or the like), and in which the state of ink is changed by the thermal energy.

Typical configuration and principle of such a method are disclosed, for example, in U.S. Pat. Nos. 4,723,129 and 4,740,796. The disclosed method can be applied to both of so-called on-demand-type and continuous-type heads. Particularly, the on-demand-type head is effective because by applying at least one driving signal corresponding to recording information for causing a rapid temperature rise exceeding nucleate boiling to an electrothermal transducer disposed so as to face a sheet holding a liquid (ink or a processing liquid) or a liquid channel in accordance with recording information, thermal energy is generated in the electrothermal transducer to cause film boiling on the heat operating surface of the recording head and to form a bubble within the liquid (ink or the processing liquid) corresponding to the driving signal.

By discharging the liquid (ink or the processing liquid) from the discharge opening due to the growth and contraction of the bubble, at least one droplet is formed. It is preferable to provide the driving signal in the form of a pulse because the bubble can be instantaneously and appropriately grown and contracted and the discharge of the liquid (ink or the processing liquid) with a high response speed can be achieved.

A pulse-shaped driving signal such as those described in U.S. Pat. Nos. 4,463,359 and 4,345,262 is suitable. By adopting conditions described in U.S. Pat. No. 4,313,124 relating to the rate of temperature rise of the heat operating surface, more excellent recording can be performed.

In addition to the configuration of combining discharging ports, a liquid channel and electrothermal transducers (a linear liquid channel or an orthogonal liquid channel) as disclosed in the above-described patent applications, configurations described in U.S. Pat. Nos. 4,558,333 and 4,459,600 in which a heat operating unit is disposed at a bent region of the liquid channel may also be adopted for the recording head of the present invention.

Instead of a cartridge-type recording head having an ink tank integrally provided therein that has been described in the foregoing embodiments, an exchangeable chip-type recording head capable of electric connection to the main body of the apparatus and ink supply from the main body of the apparatus by being mounted on the main body of the apparatus may also be used.

The addition of means for recovering a discharge operation of the recording head, preliminary auxiliary means and the like to the above-described configuration of the recording head is preferable because the recording operation can be more stabilized. More specifically, these means include capping means, cleaning means, and pressurizing or suctioning means for the recording head, and preliminary heating means using an electrothermal transducer, a heating element other than the electrothermal transducer, or a combination of these elements.

The present invention may also be applied to a recording mode using a single color, such as black or the like, an integrally formed recording head, a combination of a plurality of recording heads, and a recording apparatus which has at least one of a recording mode using a plurality of different colors and a recording mode of obtaining a full-color image by mixing colors.

As described above, according to the present invention, it is possible to change parameters so that power consumption in heating means increases when none of first and second motors operate, and power consumption in heating means decreases when one of the motors operates, and promptly control the temperature of ink within the capacity of a power supply of a recording apparatus in accordance with the operating states of the motors.

Accordingly, it is possible to suppress instantaneous maximum power consumption, perform prompt control the temperature of ink without increasing the capacity of a power supply, and record a high-quality image by preventing the generation of unevenness in the density due to variations in the amount of ink discharge and incomplete dot shapes due to a failure in ink discharge.

The individual components shown in outline or designated by blocks in the drawings are all well known in the ink-jet recording apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus that performs recording by causing an ink-jet recording head, for performing recording by discharging ink, to perform scanning on a recording medium, said apparatus comprising:

temperature acquisition means for acquiring a temperature of the recording head;

discharge heaters, provided within the recording head, for generating thermal energy for heating ink;

driving means for driving said discharge heaters in accordance with predetermined parameters;

a first motor for causing the recording head to perform scanning;

a second motor for conveying the recording medium;

determining means for determining whether at least one of said first and second motors is being driven;

driving control means for controlling said driving means in accordance with an output from said temperature detection means; and parameter changing means for changing the parameters of said driving means in accordance with a determination by said determining means as to whether at least one of said first and second motors is being driven, wherein the parameters are set such that the thermal energy generated by each of said discharge heaters is within a range such that ink will not be discharged, and wherein the change of the parameters comprises changing a driving frequency for generating the thermal energy within the range.

2. An ink-jet recording apparatus according to claim 1, wherein said parameter changing means changes the parameters so that electric power consumed by said discharge heaters is reduced while one of said first and second motors is driven.

3. An ink-jet recording apparatus according to claim 1, wherein said parameter changing means changes a period of a pulse applied to said discharge heaters.

4. An ink-jet recording apparatus according to claim 1, wherein said parameter changing means changes the parameters in accordance with an operation instruction for one of said first and second motors.

5. An ink-jet recording apparatus according to claim 1, wherein said parameter changing means changes the parameters in accordance with one of a first case in which neither of said first and second motors is driven, a second case in which only said first motor is driven, a third case in which only said second motor is driven, and a fourth case in which both of said first and second motors are driven.

6. An ink-jet recording apparatus according to claim 1, wherein said parameter changing means changes the parameters in accordance with information relating to said discharge heaters that has been measured in advance.

7. An ink-jet recording apparatus according to claim 1, further comprising four ink-jet recording heads for discharging ink liquids of four colors, black, cyan, magenta and yellow, wherein the parameters differ between the recording head for discharging black ink and the recording heads for discharging ink liquids of other colors.

8. An ink-jet recording apparatus according to claim 1, wherein a heater other than said discharge heaters is further provided and driven by said driving means.

9. An ink-temperature control method in an ink-jet recording apparatus that performs recording by causing an ink-jet recording head, for performing recording by discharging ink, to perform scanning on a recording medium, including temperature acquisition means for acquiring a temperature of the recording head, discharge heaters, provided within the recording head, for generating thermal energy for heating ink, driving means for driving the discharge heaters in accordance with predetermined parameters, a first motor for causing the recording head to perform scanning, and a second motor for conveying the recording medium, said method comprising:

a determining step of determining whether at least one of the first and second motors is being driven;

a driving control step of controlling the driving means in accordance with an output from the temperature detection means; and a parameter changing step of changing the parameters of the driving means in accordance with a determination in said determining step as to whether at least one of the first and second motors is being driven, wherein the parameters are set such that the thermal energy generated by each of the discharge heaters is within a range such that ink will not be discharged, and wherein the change of the parameters comprises changing a driving frequency for generating the thermal energy within the range.

10. An ink-temperature control method according to claim 9, wherein the parameter changing step changes the parameters so that electric power consumed by the discharge heaters is reduced while one of the first and second motors is driven.

11. An ink-temperature control method according to claim 9, wherein in said parameter changing step, a period of a pulse applied to the discharge heaters is changed.

12. An ink-temperature control method according to claim 9, wherein in said parameter changing step, the parameters are changed in accordance with an operation instruction for one of the first and second motors.

13. A An ink-temperature control method according to claim 9, wherein in said parameter changing step, the parameters are changed in accordance with one of a first case in which neither of the first and second motors is driven, a second case in which only the first motor is driven, a third case in which only the second motor is driven, and a fourth case in which both of the first and second motors are driven.

14. An ink-temperature control method according to claim 9, wherein in said parameter changing step, the parameters are changed in accordance with information relating to the discharge heaters that has been measured in advance.

15. An ink-temperature control method according to claim 9, wherein the recording apparatus further includes four ink-jet recording heads for discharging ink liquids of four colors, black, cyan, magenta and yellow, and wherein the parameters differ between the recording head for discharging black ink and the recording heads for discharging ink liquids of other colors.

16. An ink-temperature control method according to claim 9, wherein the recording apparatus further includes a heater other than the discharge heaters, the other heater being driven by the driving means.

* * * * *

UNITED STATES PATENT AND TRADEMARK OFFICE

CERTIFICATE OF CORRECTION

PATENT NO. : 6,767,080 B2
DATED : July 27, 2004
INVENTOR(S) : Kanematsu

It is certified that error appears in the above-identified patent and that said Letters Patent is hereby corrected as shown below:

Column 6,
Line 52, “With” should read -- with --.

Column 10,
Line 1, “bead” (both occurrences) should read -- head --.
Line 3, “(beating” should read -- (heating --.

Column 11,
Line 25, “present absent” should read -- absent --.

Column 16,
Line 22, “A” should be deleted.

Signed and Sealed this

Twenty-second Day of March, 2005

JON W. DUDAS
*Director of the United States Patent and Trademark Office*